US006830092B1

(12) United States Patent
Hsu

(10) Patent No.: US 6,830,092 B1
(45) Date of Patent: Dec. 14, 2004

(54) DECORATION ARTICLE SECURED TO THE ENDS OF UPPER BEAM OF VENETIAN BLIND

(75) Inventor: Ben Hsu, Changhua Hsien (TW)

(73) Assignee: Ching-Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/617,384

(22) Filed: Jul. 11, 2003

(51) Int. Cl.[7] ..... E06B 9/323
(52) U.S. Cl. ..... 160/178.1 R; 160/348
(58) Field of Search ..... 160/38, 39, 19, 160/330, 348, 349.1, 349.2, 178.1 R; 428/28; 211/105.1

(56) References Cited

U.S. PATENT DOCUMENTS 3,693,210 A * 9/1972 MacFarlane et al. ..... 16/87 R
5,615,721 A * 4/1997 Winter ..... 160/38
5,642,595 A * 7/1997 Daniels et al. ..... 52/301
5,670,221 A * 9/1997 Bried et al. ..... 428/28
5,678,703 A * 10/1997 Sawyer ..... 211/105.1
6,112,801 A * 9/2000 Daniels et al. ..... 160/330
6,206,074 B1 * 3/2001 Liu ..... 160/38
6,302,180 B1 * 10/2001 Yu ..... 160/38
6,595,478 B2 * 7/2003 Lee ..... 248/262

* cited by examiner

*Primary Examiner*—David Purol
(74) *Attorney, Agent, or Firm*—Troxell Law Office PLLC

(57) ABSTRACT

A decoration article secured to the ends of an upper beam of a Venetian blind is mainly made up of a decoration unit, and a fixing mount wherein the decoration unit has a decoration piece disposed at one side to increase the overall beauty of the Venetian blind in display, and a retaining tube with screw locking hole disposed at the other side thereof to be securely engaged with a hollow coupling tube of the fixing mount for location thereof. The fixing mount also includes a horizontal contact plate to be attached to the lower side at the ends of a wooden or plastic upper beam or to the upper side of a metallic upper beam of a Venetian blind thereof. Thus, a blind fabric of various materials such as silk or lace, chosen according to the favor and taste of the users, can be collected around the hollow coupling tube of the fixing mount and held thereto to form a wavy arc pattern at the front side of the Venetian blind thereof and suspend regularly downwards in wavy folds at both sides thereof for further decoration, visually increasing the artistic texture of the Venetian blind in display, and economically boosting the benefits of the Venetian blind thereof in the market.

3 Claims, 7 Drawing Sheets

DECORATION ARTICLE SECURED TO THE ENDS OF UPPER BEAM OF VENETIAN BLIND

BACKGROUND OF THE INVENTION

The present invention is related to a decoration article secured to the ends of an upper beam of a Venetian blind, mainly made up of a decoration unit, and a fixing mount wherein the decoration unit has a decoration piece disposed at one side for decoration thereof, and a retaining tube disposed at the other side thereof to be engaged with a hollow coupling tube of the fixing mount for location thereof. The fixing mount also includes a horizontal contact plate disposed at one side thereof to be attached to the ends of a wooden, plastic, or metallic upper beam of a Venetian blind therewith. Thus, a blind fabric made of silk or lace, etc. chosen according to the favor and taste of the users, can be hanged onto the hollow coupling tube thereof and decoratively held thereto to form a wavy arc pattern at the front side of the Venetian blind and suspend regularly downwards in wavy folds at both sides thereof, visually increasing the overall beauty and the artistic texture of the Venetian blind in display, and economically boosting the benefits of the Venetian blind thereof in the market.

There are some conventional blind structures found in the market. Please refer to FIG. 1. A conventional blind structure is made up of a wooden upper beam 1, and a blind body 2 attached to the bottom of the wooden upper beam 1 thereof wherein the blind body 2 is of a fabric drapery.

Please refer to FIG. 2. A second conventional blind structure comprises a plastic upper beam 1', and a blind body 2' attached to the bottom of the plastic upper beam 1' wherein the blind body 2' is made up of plastic blades or bamboo plates.

Please refer to FIG. 3. A third conventional blind structure includes a metallic upper beam 1" made up of a pair of large and small extensible tubes, and a blind body 2" attached to the bottom of the metallic upper beam 1" wherein the blind body 2" is of fabric drapery.

There are some drawbacks to such conventional blind structures. Most of all, the above conventional blind structures are one-dimensionally made for the single purpose of sheltering without any other decorative articles attached to either the wooden and plastic upper beams 1, 1' or the metallic upper beam 1" thereof, which, rather monotonously boring in both practical use and visual effect, makes them plainly inartistic in texture and economically uncompetitive in the market.

SUMMARY OF THE PRESENT INVENTION

It is, therefore, the primary purpose of the present invention to provide a decoration article secured to the ends of an upper beam of a Venetian blind, mainly made up of a decoration unit having a decoration piece disposed at one side to increase the overall beauty of the Venetian blind in display, and a fixing mount having a horizontal contact plate to be secured to the ends of a wooden, plastic, or metallic upper beam of a Venetian blind and a hollow coupling tube for a retaining tube of the decoration unit to be engaged therewith for location thereof; whereby, a blind fabric of various materials such as silk or lace, chosen according to the favor and taste of the users, can be hanged onto the hollow coupling tube thereof and decoratively held thereto to form a wavy arc pattern at the front side of the Venetian blind and suspend regularly downwards in wavy folds at both sides thereof, increasing the artistic texture of the Venetian blind in display, and boosting the economical benefits of the Venetian blind thereof in the market.

DETAILED DESCRIPTION OF THE PREFERRED EMBODIMENTS

Figure 1:
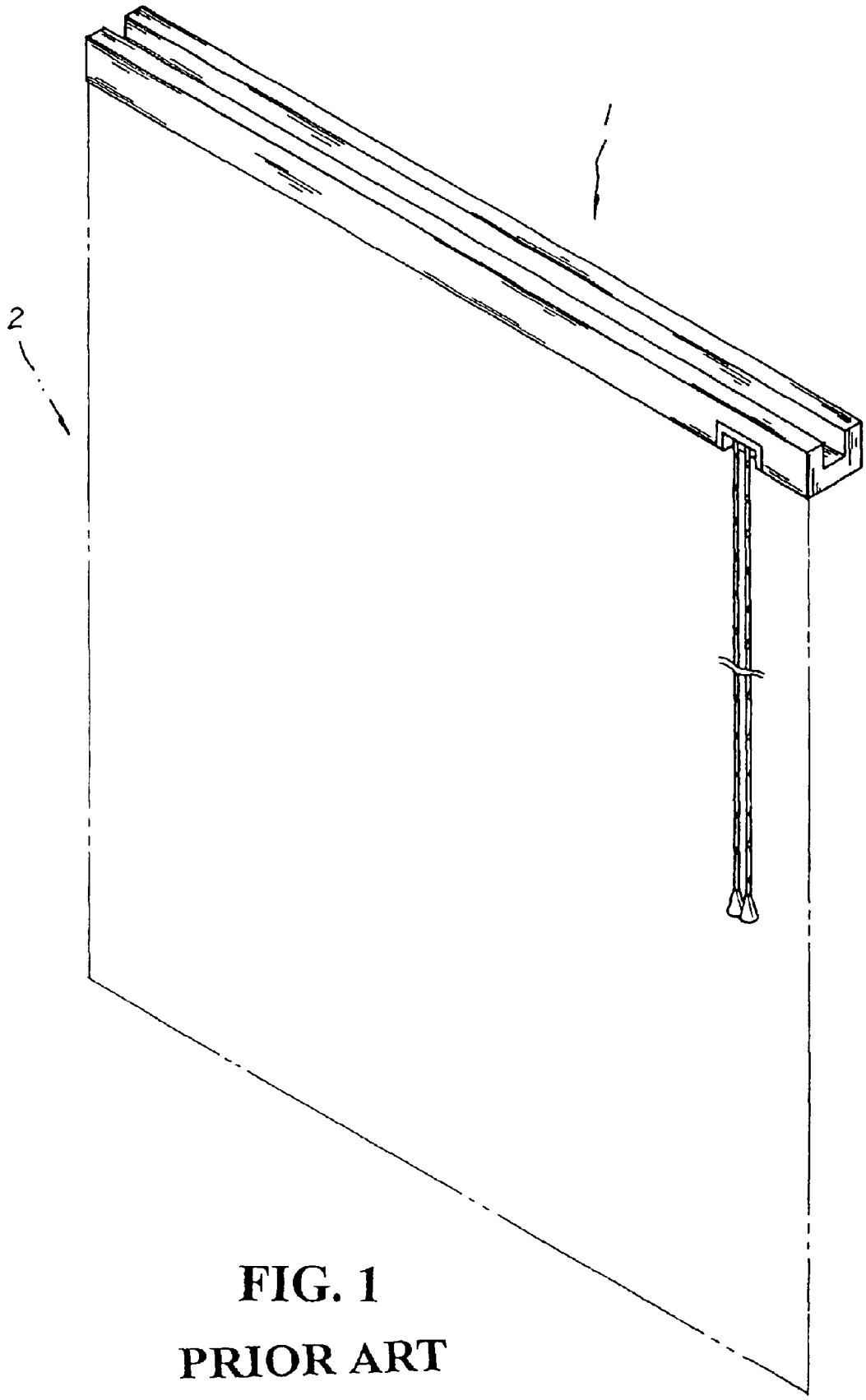
FIG. 1 PRIOR ART
FIG. 1 is a perspective view of a conventional Venetian blind structure.
Figure 2:
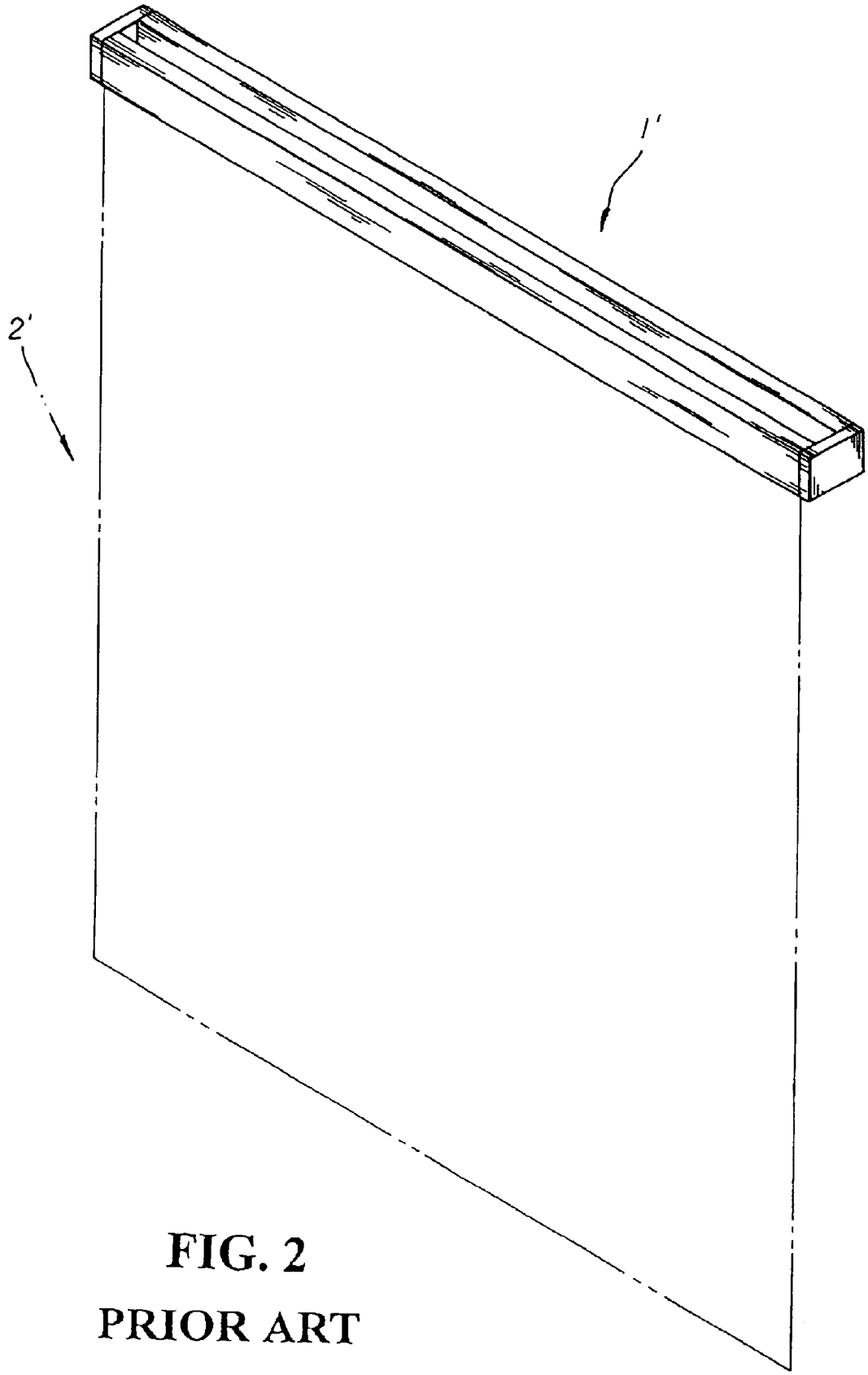
FIG. 2 PRIOR ART
FIG. 2 is a perspective view of a second conventional Venetian blind structure.
Figure 3:
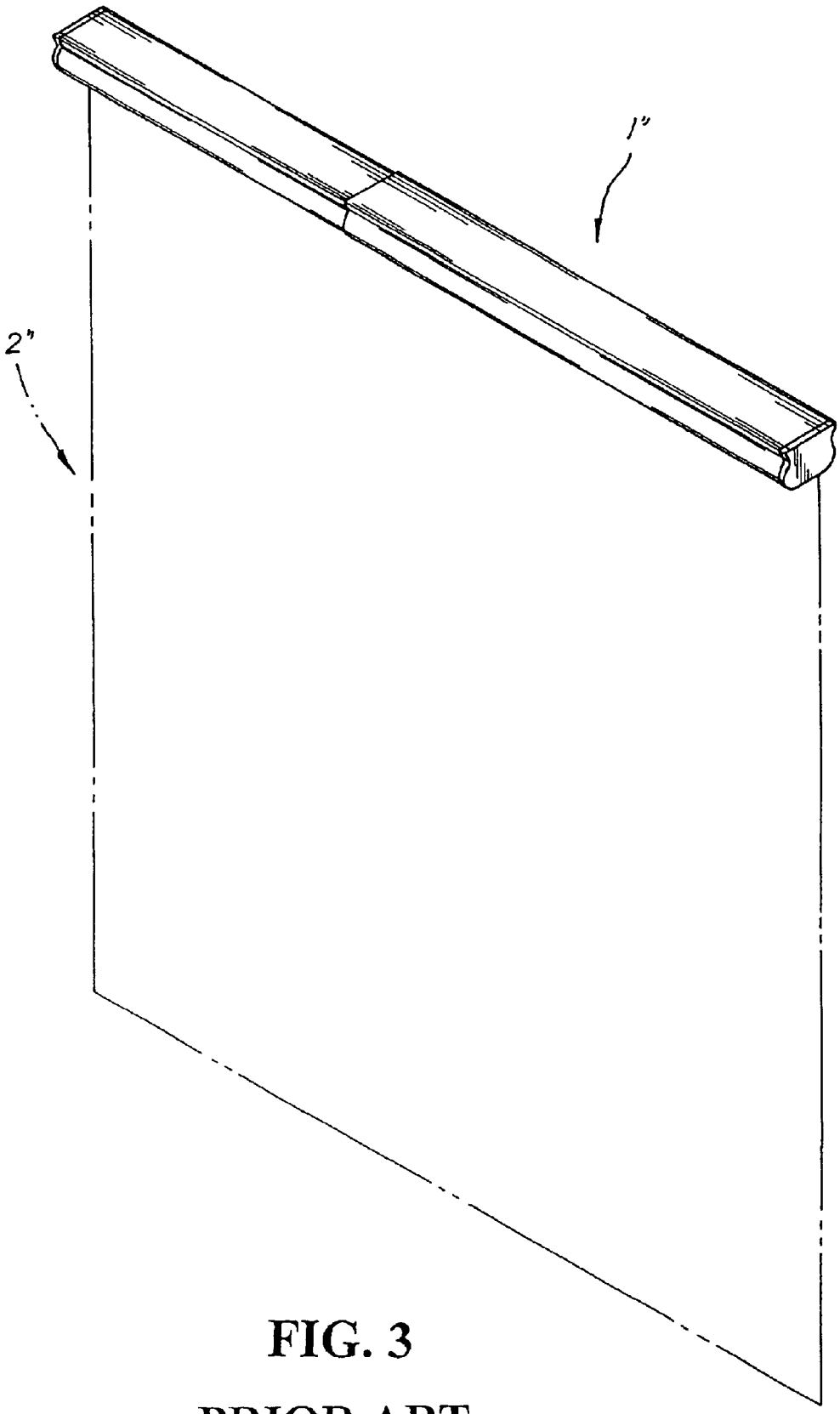
FIG. 3 PRIOR ART
FIG. 3 is a perspective view of a third conventional Venetian blind structure.
Figure 4:
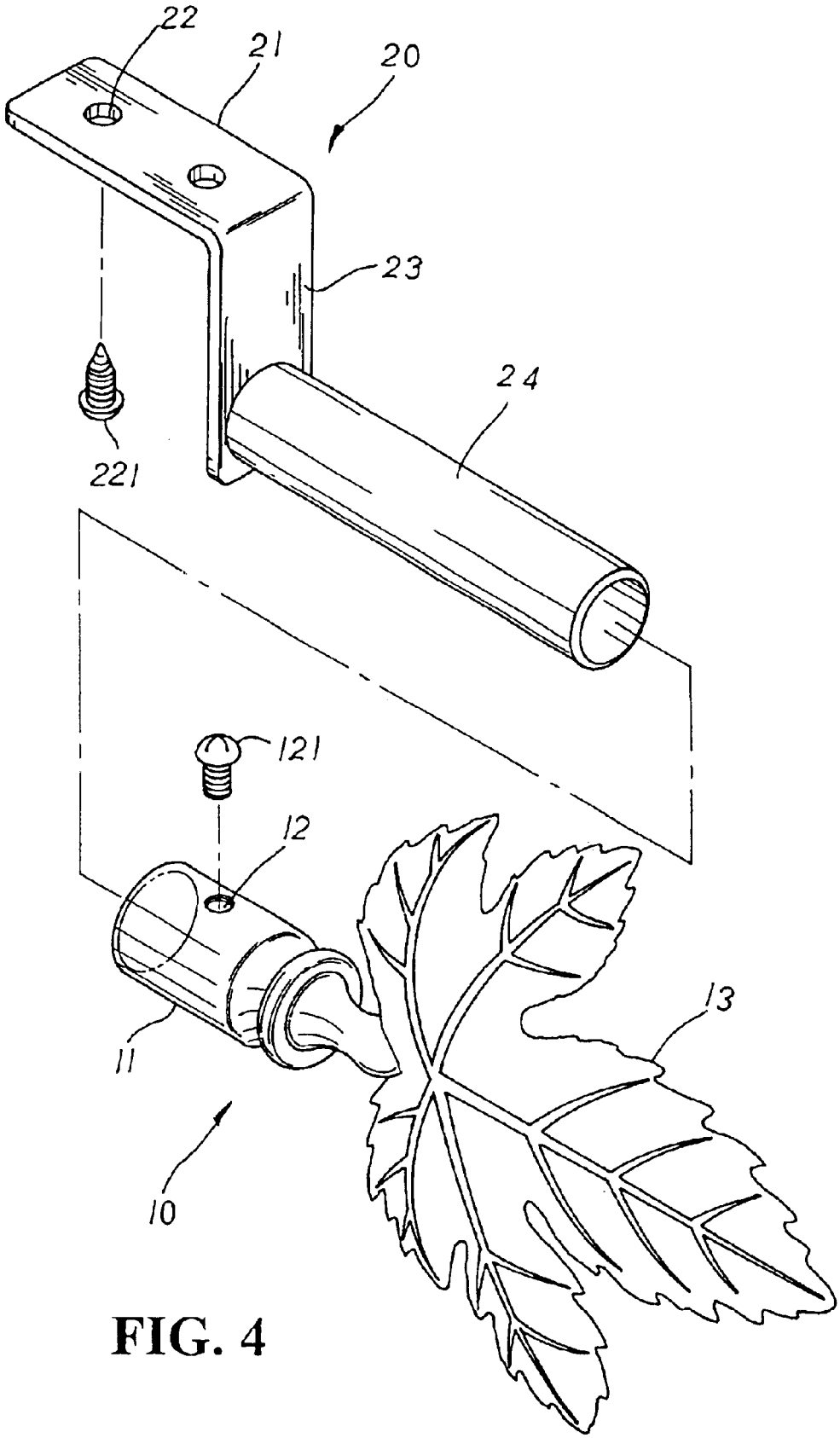
FIG. 4 is a perspective exploded view of the present invention.

Please refer to FIG. 4. The present invention is related to a decoration article secured to the ends of an upper beam of a Venetian blind, mainly made up of a decoration unit 10, and a fixing mount 20. The decoration unit 10 includes a retaining tube 11 disposed at one side thereof, a screw locking hole 12 matching to a screw 121 disposed at the upper side of the retaining tube 11 thereof, and a decoration piece 13 disposed at the other side thereof. The fixing mount 20 is made of metal, having a horizontal contact plate 21 disposed at one side thereof, two fixing holes 22 matching to two fixing members 221 equidistantly disposed at the horizontal contact plate 21 thereon, a connection plate 23 extending vertically downwards at one side of the horizontal contact plate 21 thereof, and a hollow coupling tube 24 protruding transversely at the lower section of the connection plate 23 thereof.

Figure 5:
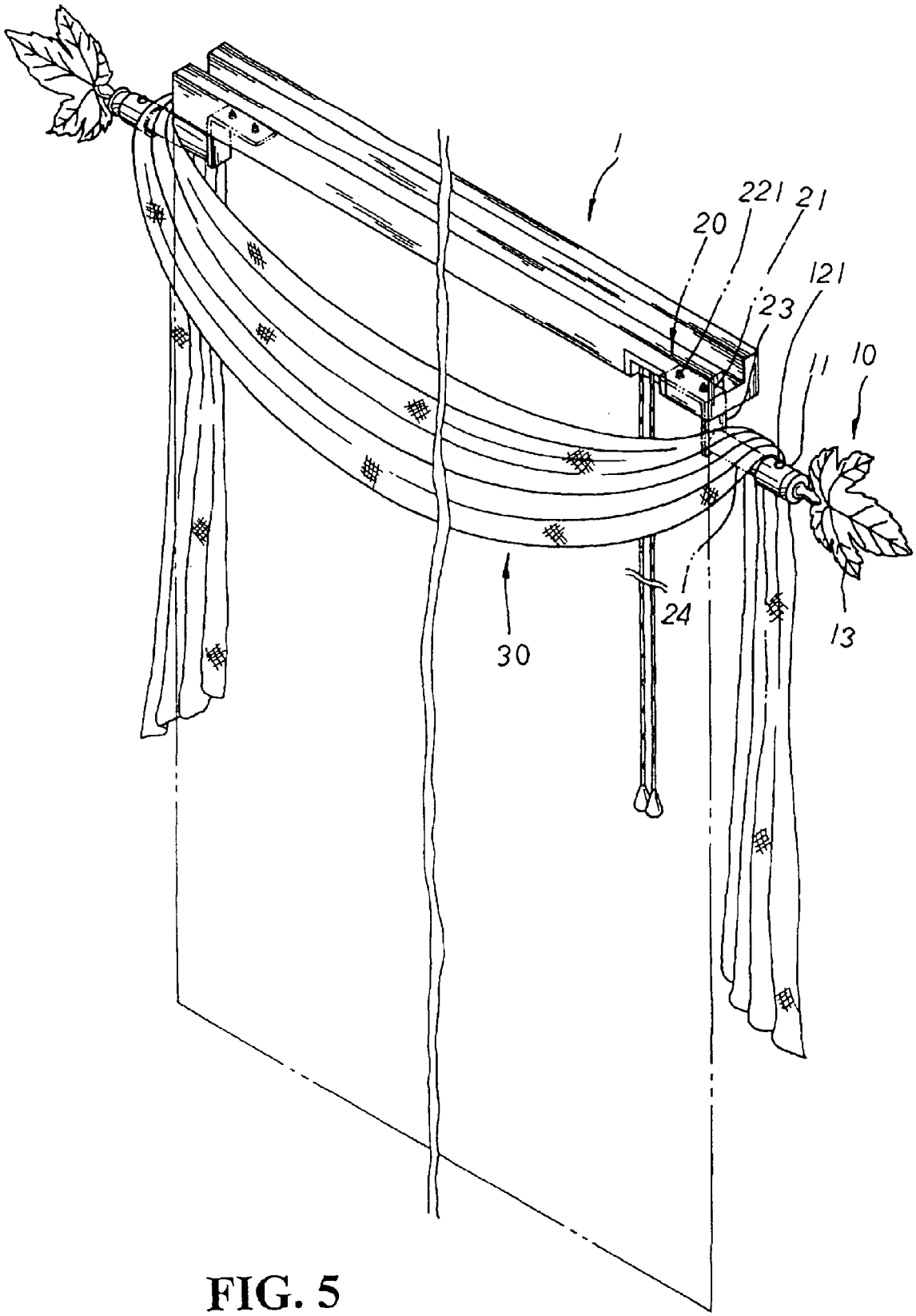
FIG. 5 is a perspective view of the present invention attached to a wooden upper beam in practical use.
Figure 6:
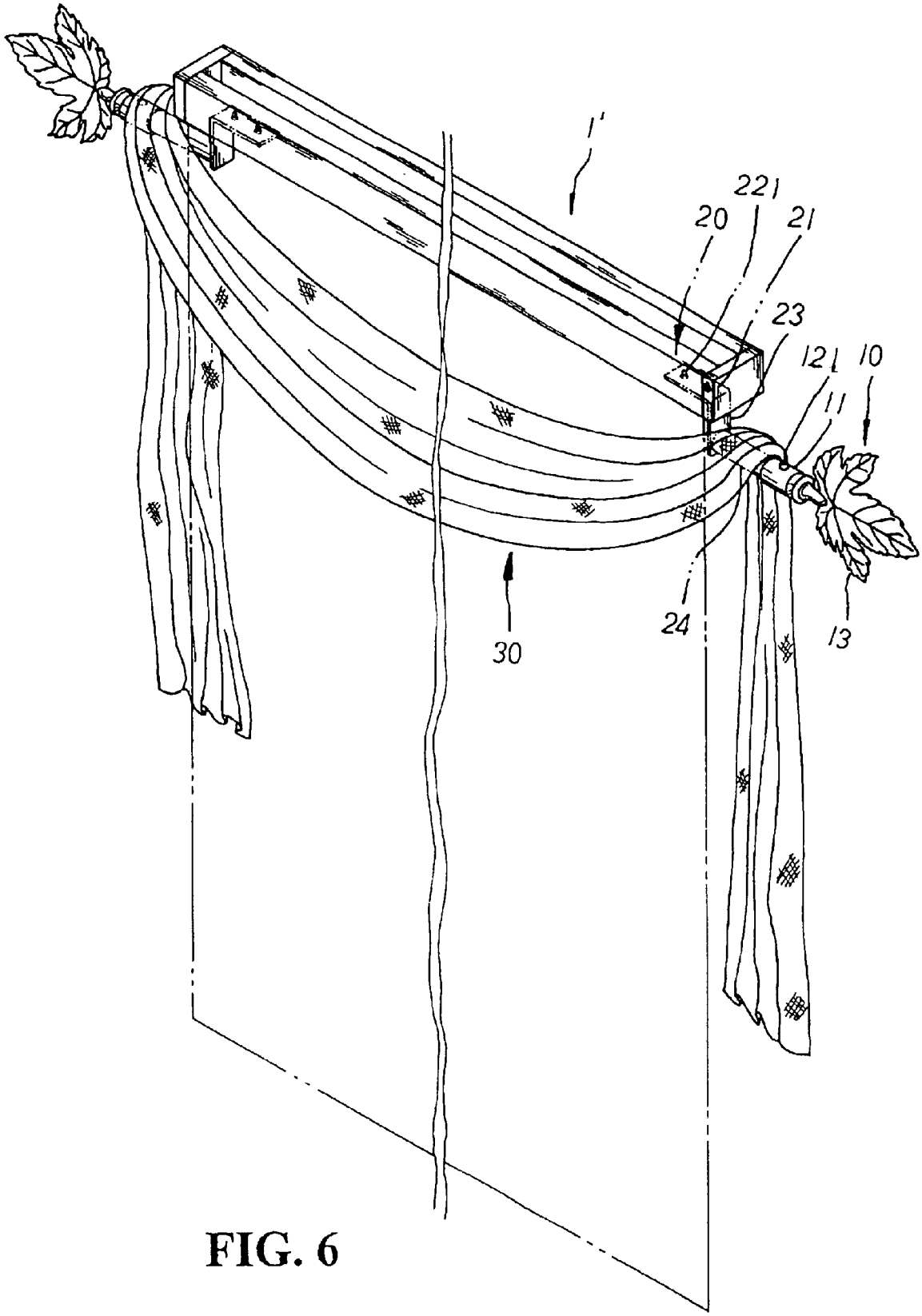
FIG. 6 is another perspective view of the present invention attached to a plastic upper beam in practical use.
Figure 7:
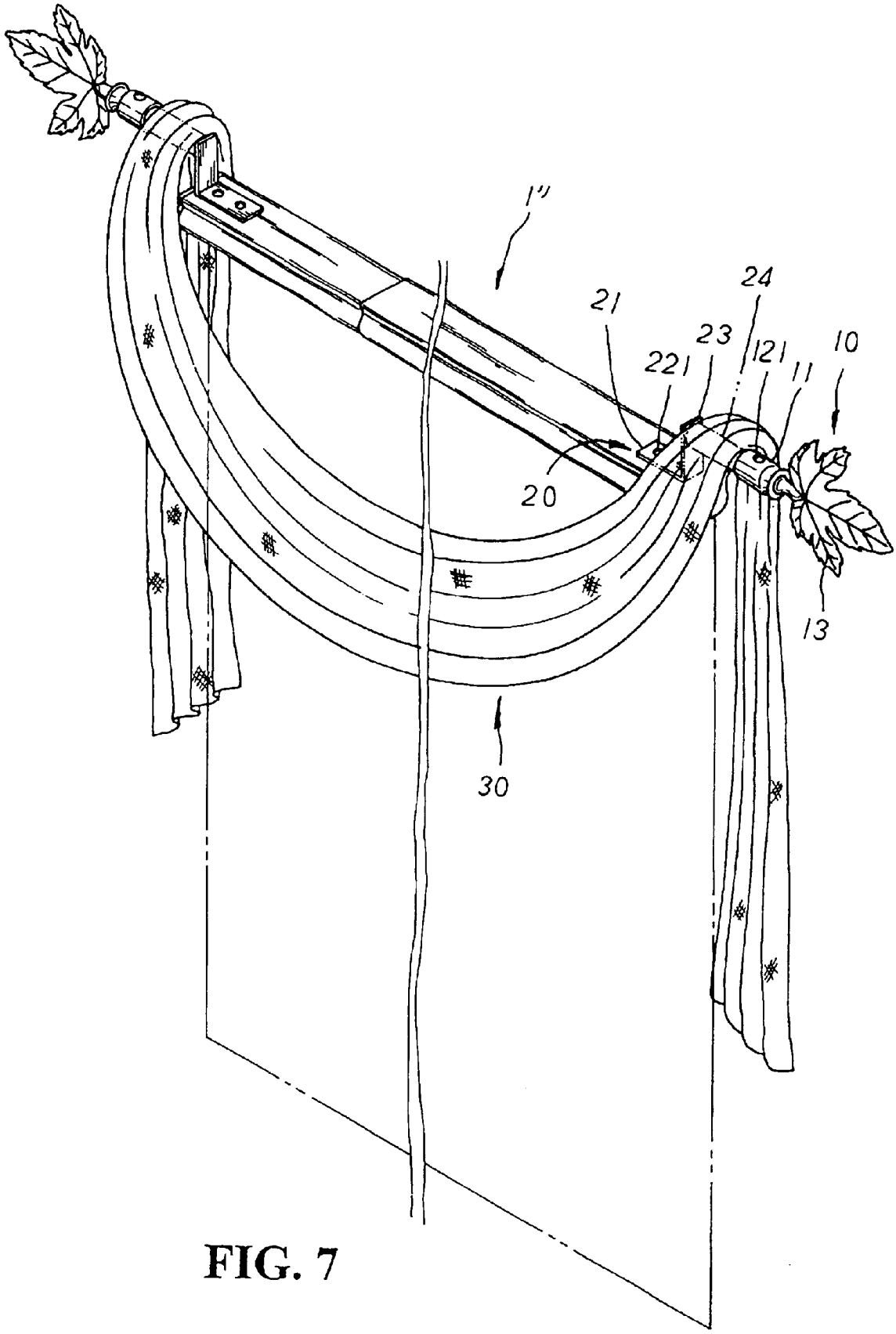
FIG. 7 is a third perspective view of the present invention attached to a pair of large and small metallic upper beam in practical use.

In practical use, the horizontal contact plate 21 of the fixing mount 20 is abutted against the lower side at the ends of a wooden upper beam 1, or a plastic upper beam 1' as shown in FIGS. 5, 6 respectively. Otherwise, the horizontal contact plate 21 of the fixing mount 20 is turned in 180 degree to be abutted against the upper side at the ends of a metallic upper beam 1" as shown in FIG. 7. The fixing mount 20 is attached to the wooden upper beam 1, the plastic upper beam 1', or the metallic upper beam 1" thereof via the fixing members 221 led through the fixing holes 22 thereof for secure location thereof. The retaining tube 11 of the decoration unit 10 is then joined to the hollow coupling tube 24 of the fixing mount 20 and fixedly locked thereto via the screw 121 led through the screw locking hole 12 thereof to be abutted tightly against the hollow coupling tube 24 for location thereof to complete the assembly of the present invention. Via the engaged decoration unit 10 and the fixing mount 20 thereof, a blind fabric of various materials such as silk or lace, chosen according to the favor and taste of the users, can be hanged onto the upper beams 1, 1', 1" of the Venetian blind thereof for further decoration as shown in FIGS. 5, 6, 7 respectively. The blind fabric thereof is collected around the hollow coupling tube 24 of the fixing mount 20 thereof to form a wavy arc pattern at the front side of the Venetian blind and suspended regularly downwards in wavy folds at both sides thereof, not only visually increasing the overall beauty and the artistic texture of the Venetian blind in display, and also economically boosting the benefits of the Venetian blind thereof in the market.

What is claimed is:

1. A decoration article for a window comprising:

a) a fixing mount having:

i) a horizontal contact plate having at least one fixing hole;

ii) a vertical contact plate connected to the horizontal contact plate; and iii) a coupling member connected to the vertical contact plate; and b) a decoration unit having:

i) a retaining member with a hollow interior and a screw locking hole, the coupling member being removably and slidably inserted in the hollow interior of the retaining member;

ii) a decoration piece connected to the retaining member; and iii) a locking screw adjustably inserted into the screw locking hole, wherein, when the coupling member of the fixing mount is slidably inserted into the retaining member of the decoration unit, the locking screw is adjusted to selectively lock the decoration unit to and release the decoration unit from the fixing mount.

2. The decoration article according to claim 1, wherein the fixing mount is made of a metallic material.

3. The decoration article according to claim 1, wherein the coupling member is a hollow tube.

* * * * *